US006501445B1

(12) United States Patent
Kim

(10) Patent No.: US 6,501,445 B1
(45) Date of Patent: Dec. 31, 2002

(54) APPARATUS FOR DRIVING PLASMA DISPLAY PANEL

(75) Inventor: Sang-Chul Kim, Cheonan (KR)

(73) Assignee: Samsung SDI Co., Ltd., Kyungki-Do (KR)

( * ) Notice: Subject to any disclaimer, the term of this patent is extended or adjusted under 35 U.S.C. 154(b) by 0 days.

(21) Appl. No.: 09/549,162

(22) Filed: Apr. 13, 2000

(30) Foreign Application Priority Data

Apr. 15, 1999 (KR) ..... 99-13325

(51) Int. Cl.[7] ..... G09G 3/28
(52) U.S. Cl. ..... 345/61; 315/169.2; 315/169.4
(58) Field of Search ..... 345/60–70, 208–210; 315/169.1–169.4

(56) References Cited

U.S. PATENT DOCUMENTS 4,866,349 A 9/1989 Weber et al. ..... 315/169.4
5,446,344 A 8/1995 Kanazawa ..... 315/169.4
5,677,600 A * 10/1997 Takahashi et al. ..... 315/169.4
5,835,072 A * 11/1998 Kanazawa ..... 345/60
5,943,030 A * 8/1999 Minamibayashi ..... 345/60
6,100,859 A * 8/2000 Kuriyama et al. ..... 345/60
6,211,865 B1 * 4/2001 Hosoi et al. ..... 345/204
6,239,775 B1 * 5/2001 Kang ..... 345/60

FOREIGN PATENT DOCUMENTS

KR 97-17861 4/1997

* cited by examiner

*Primary Examiner*—Lun-Yi Lao
(74) *Attorney, Agent, or Firm*—Lowe Hauptman Gilman & Berner, LLP

(57) ABSTRACT

An apparatus for driving a three-electrode alternating current (AC) surface discharge plasma display panel (PDP) includes a scanning driver, an address driver, a common driver and a controller. The scanning driver, in which a scanning circuit is combined with a discharge sustaining circuit with respect to each of the scan electrode lines, applies scanning signals to scan electrode lines in response to scan data in a predetermined scanning order during an address period for forming wall charges at pixels to be selected and also applies discharge sustaining signals to scan electrode lines in response to discharge sustain data during a sustain-discharge period for generating light at the selected pixels.

9 Claims, 4 Drawing Sheets

APPARATUS FOR DRIVING PLASMA DISPLAY PANEL

BACKGROUND OF THE INVENTION

1. Field of the Invention

The present invention relates to an apparatus for driving a plasma display panel (PDP), and more particularly, to an apparatus for driving a three-electrode alternating-current (AC) surface discharge type PDP using an address-while-display driving method.

2. Description of the Related Art

FIG. 1 shows a general three-electrode AC surface-discharge type PDP. FIG. 2 shows an electrode line pattern of the PDP shown in FIG. 1. FIG. 3 shows another view of one pixel in the PDP of FIG. 1. Referring to the drawings, address electrode lines $A_1, A_2, A_3, \ldots, A_{m-1}$ and $A_m$, a dielectric layer 11 (and/or 141 of FIG. 3), scan electrode lines $Y_1, Y_2, \ldots, Y_n$, common electrode lines $X_1, X_2, \ldots, X_n$ and a MgO layer 12 as a protective layer are provided between front and rear glass substrates 10 and 13 of a general surface-discharge PDP 1.

The address electrode lines $A_1, A_2, A_3, \ldots, A_{m-1}$ and $A_m$, are coated over the front surface of the rear glass substrate 13 in a predetermined pattern. Phosphors (142 of FIG. 3) may be coated over the front surface of the address electrode lines $A_1, A_2, \ldots, A_{m-1}$ and $A_m$. Otherwise, the phosphors 142 may be coated on the dielectric layer 141 of FIG. 3 in the event that the dielectric layer 141 is coated over the address electrode lines $A_1, A_2, \ldots, A_{m-1}$, and $A_m$ in a predetermined pattern.

The common electrode lines $X_1, X_2, \ldots, X_n$ and the scan electrode lines $Y_1, Y_2, \ldots, Y_n$ are arranged on the rear surface of the front glass substrate 10 so as to be orthogonal to the address electrode lines $A_1, A_2, A_3, \ldots, A_{m-1}$ and $A_m$ in a predetermined pattern. The respective intersections define corresponding pixels. The common electrode lines $X_1, X_2, \ldots, X_n$ and the scan electrode lines $Y_1, Y_2, \ldots, Y_n$ are each comprised of indium tin oxide (ITO) electrode lines $X_{na}$ and $Y_{na}$ and a metal bus electrode lines $X_{nb}$ and $Y_{nb}$, as shown in FIG. 3. The dielectric layer 11 is entirely coated over the rear surface of the common electrode lines $X_1, X_2, \ldots, X_n$ and the scan electrode lines $Y_1, Y_2, \ldots, Y_n$. The MgO layer 12 for protecting the panel 1 against a strong electrical field is entirely coated over the rear surface of the dielectric layer 11. A gas for forming plasma is hermetically sealed in a discharge space 14.

The driving method generally adopted to the PDP described above is a method in which a reset step, an address step and a sustain-discharge step are sequentially performed in a unit sub-field. In the reset step, residual wall charges in the previous field are removed. In the address step, wall charges are produced at selected pixels. In the sustain-discharge step, light is emitted from pixels at which the wall charges have been formed in the address step. In other words, when an AC pulse of a relatively high voltage is applied between the common electrode lines $X_1, X_2, \ldots, X_n$ and the scan electrode lines $Y_1, Y_2, \ldots, Y_n$, surface discharges occur at the pixels at which the wall charges are formed. At this time, plasma is formed in a gas layer, and the phosphors 142 is excited due to radiation of ultraviolet rays, thereby generating light.

A plurality of unit sub-fields having the above basic operating principal are included in a unit frame, thereby displaying a desirable gradation due to different times of the sustain-discharge periods of the sub-fields.

In an apparatus for driving the PDP described above, conventionally, a scanning driver and a discharge sustaining driver are separately provided to drive the scan electrode lines $Y_1, Y_2, \ldots, Y_n$. The scanning driver applies scanning signals to the scan electrode lines $Y_1, Y_2, \ldots, Y_n$ in response to scan data in a predetermined scanning order during an address period for forming wall charges at pixels to be selected. The discharge sustaining driver applies discharge sustaining signals to the scan electrode lines $Y_1, Y_2, \ldots, Y_n$ in response to discharge sustain data during a sustain-discharge period for generating light at the selected pixels. As described above, the scanning driver and the discharge sustaining driver are separately provided to drive the scan electrode lines $Y_1, Y_2, \ldots, Y_n$ because it is preferable that the level of a positive polarity voltage used during the address period is different from the level of a negative polarity voltage used during the sustain-discharge period, and the level of a negative polarity voltage used during the address period is different from the level of the negative polarity voltage used during the sustain-discharge period. However, the structure having separated drivers has a disadvantage of complicating a driving circuit and a control algorithm and increasing manufacturing costs.

SUMMARY OF THE INVENTION

To solve the above problem, an object of the present invention is to provide an apparatus for driving a plasma display panel, which can simplify a driving circuit and a control algorithm and reduce manufacturing costs.

To achieve the above object, the present invention provides an apparatus for driving a plasma display panel (PDP) having front and rear substrates to be separated and opposed to each other and having common, scan and address electrode lines between the front and rear substrates, the common electrode lines and the scan electrode lines being arranged in parallel, the address electrode lines being arranged to be orthogonal to the scan electrode lines, thereby defining pixels corresponding to the respective intersections.

The apparatus includes a scanning driver, an address driver, a common driver and a controller. The scanning driver, in which a scanning circuit is combined with a discharge sustaining circuit with respect to each of the scan electrode lines, applies scanning signals to the scan electrode lines in response to scan data in a predetermined scanning order during an address period for forming wall charges at pixels to be selected and applies discharge sustaining signals to the scan electrode lines in response to discharge sustain data during a sustain-discharge period for generating light at the selected pixels. The address driver applies address signals to the address electrode lines in response to an input display data signal. The common driver applies common signals to the common electrode lines in response to an input common data signal. The controller processes externally input image data and generates the scanning data, the discharge sustain data, the display data signal and the common data signal.

According to the present invention, the scanning driver applies the scanning signals to the scan electrode lines in response to the scan data during the address period and also applies the discharge sustaining signals to the scan electrode lines in response to the discharge sustain data during the sustain-discharge period. Accordingly, the present invention does not require an additional discharge sustaining driver for the scan electrode lines, thereby simplifying a driving circuit and a control algorithm and decreasing manufacturing costs.

BRIEF DESCRIPTION OF THE DRAWINGS

The above object and advantage of the present invention will become more apparent by describing in detail preferred embodiments thereof with reference to the attached drawings in which.

DETAILED DESCRIPTION OF THE INVENTION

Figure 4:
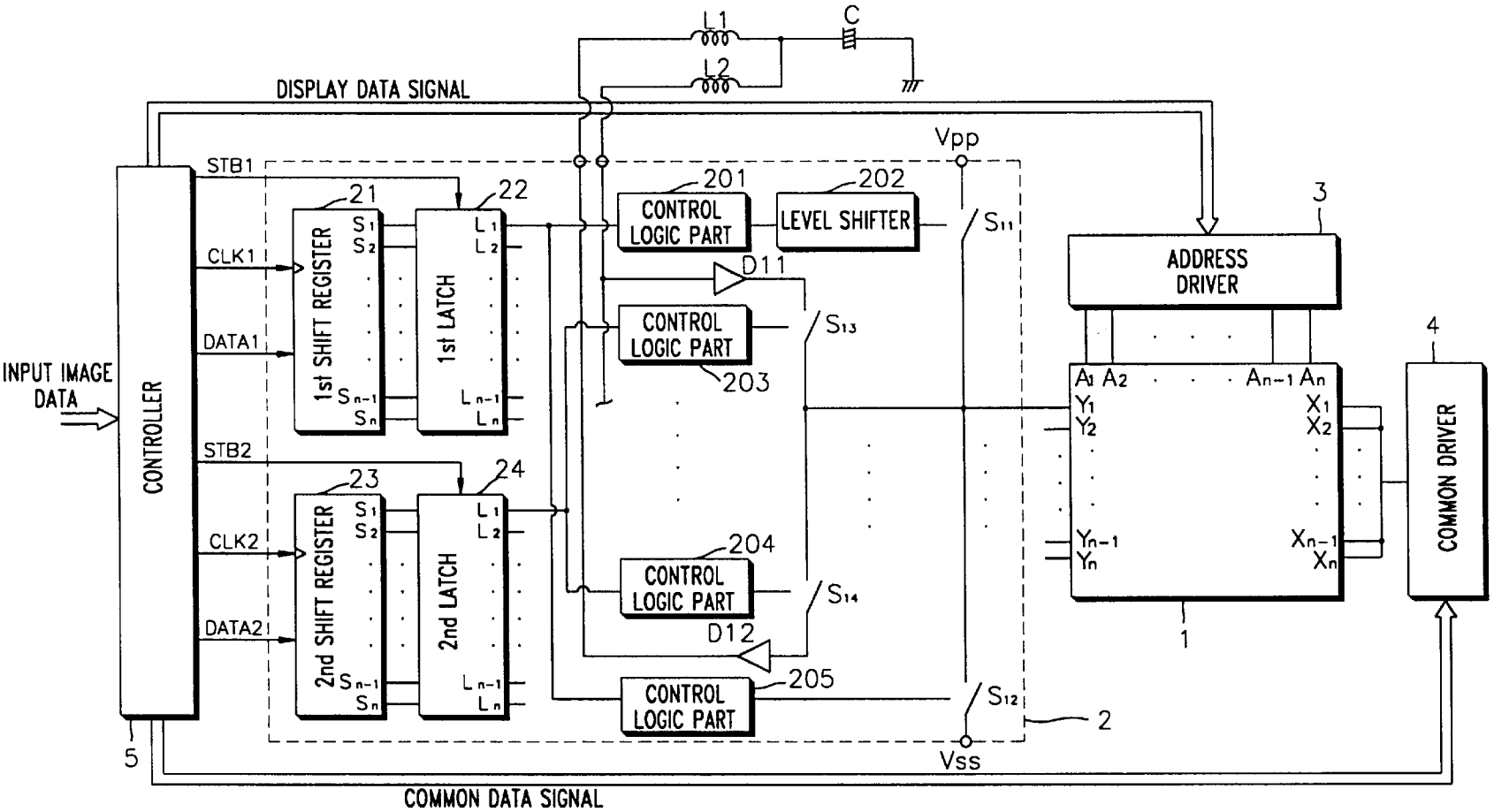
FIG. 4 is a block diagram of an apparatus for driving a PDP according to an embodiment of the present invention.

Referring to FIG. 4, an apparatus for driving a plasma display panel (PDP) 1 according to an embodiment of the present invention includes a scanning driver 2, an address driver 3, a common driver 4 and a controller 5.

The scanning driver 2, in which a scanning circuit 21, 22, 201, 202, 205, $S_{11}$ and $S_{12}$ is combined with a discharge sustaining circuit 23, 24, 203, 204, L1, L2, C, D11, D12, $S_{11}$, $S_{12}$, $S_{13}$ and $S_{14}$ with respect to each of the scan electrode lines $Y_1, Y_2, \ldots, Y_{n-1}$ and $Y_n$, applies scanning signals to the scan electrode lines $Y_1, Y_2, \ldots, Y_{n-1}$ and $Y_n$ in response to scan data DATA1 in a predetermined scanning order during an address period for forming wall charges at pixels to be selected and applies discharge sustaining signals to the scan electrode lines $Y_1, Y_2, \ldots, Y_{n-1}$ and $Y_n$ in response to discharge sustain data DATA2 during a sustain-discharge period for generating light at the selected pixels.

The address driver 3 applies address signals to address electrode lines $A_1, A_2, \ldots, A_n$ in response to an input display data signal. The common driver 4 applies common signals to common electrode lines $X_1, X_2, \ldots, X_n$ in response to an input common data signal. The controller 5 processes externally input image data and generates the scanning data DATA1, the discharge sustain data DATA2, the display data signal, and the common data signal.

Figure 5:
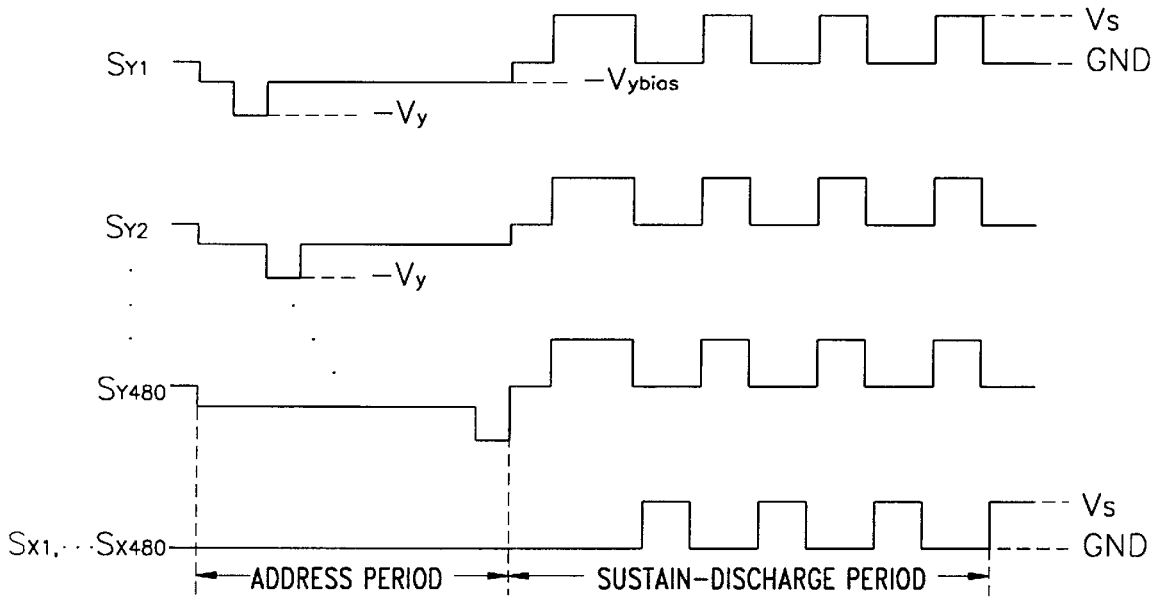
FIG. 5 is a waveform diagram illustrating driving signals output from the apparatus of FIG. 4.

FIG. 5 shows driving signals output from the apparatus of FIG. 4. In FIG. 5, reference characters $S_{y1}, S_{y2}, \ldots, S_{y480}$ denote the driving signals applied to the scan electrode lines, and reference characters $S_{x1}, S_{x2}, \ldots, S_{x480}$ denote the driving signals applied to the common electrode lines. In FIG. 4, reference characters Vpp and Vss denote power source terminals for the scan electrodes. During the address period, a bias voltage-Vybias of FIG. 5 for scanning is applied to the power source terminal Vpp and a scanning voltage-Vy of FIG. 5 is applied to the power source terminal Vss. During the sustain-discharge period, a discharge sustaining voltage Vs of FIG. 5 is applied to the power source terminal Vpp and a ground voltage GND is applied to the power source terminal Vss.

Referring to FIGS. 4 and 5, the scanning circuit 21, 22, 201, 202, 205, $S_{11}$ and $S_{12}$ of the scanning driver 2 includes a 1st shift register 21 for scanning and a switching circuit 22, 201, 202, 205, $S_{11}$ and $S_{12}$ for scanning. The number of outputs $S_1, S_2, S_{n-1}$ and $S_n$ of the 1st shift register 21 is equal to that of the scan electrode lines $Y_1, Y_2, \ldots, Y_n$ so as to sequentially output the scan data DATA1 from the controller 5 through the outputs $S_1, S_2, S_{n-1}$ and $S_n$ during the address period. A scanning clock signal CLK1 from the controller 5 controls the shift timing of the 1st shift register 21. The switching circuit 22, 201, 202, 205, $S_{11}$ and $S_{12}$ for scanning selectively applies the scanning voltage-Vy to the scan electrode lines $Y_1, Y_2, \ldots, Y_{n-1}$ and $Y_n$ in response to the scan data DATA1 from the outputs $S_1, S_2, S_{n-1}$, and $S_n$ of the 1st shift register 21 during the address period.

The discharge sustaining circuit 23, 24, 203, 204, L1, L2, C, D11, D12, $S_{11}$, $S_{12}$, $S_{13}$ and $S_{14}$ of the scanning driver 2 includes a 2nd shift register 23 for sustaining discharge and a switching circuit 24, 203, 204, L1, L2, C, D11, D12, $S_{11}$, $S_{12}$, $S_{13}$ and $S_{14}$ for sustaining discharge. The number of outputs $S_1, S_2, S_{n-1}$ and $S_n$ of the 2nd shift register 23 is equal to that of the scan electrode lines $Y_1, Y_2, \ldots, Y_n$ so as to sequentially output the discharge sustain data DATA2 from the controller 5 through the outputs $S_1, S_2, S_{n-1}$ and $S_n$ during the sustain-discharge period. A discharge sustaining clock signal CLK2 from the controller 5 controls the shift timing of the 2nd shift register 23. The switching circuit 24, 203, 204, L1, L2, C, D11, D12, $S_{11}$ $S_{12}$, $S_{13}$ and $S_{14}$ for sustaining discharge is provided with a charge/discharge circuit L1, L2 and C for recovering and using capacitive power consumption between the common electrode lines $X_1, X_2, \ldots, X_n$ and the scan electrode lines $Y_1, Y_2, \ldots, Y_n$ so as to apply the discharge sustaining voltage Vs to the scan electrode lines $Y_1, Y_2, \ldots, Y_n$ in response to the discharge sustain data output from the outputs $S_1, S_2, \ldots S_{n-1}$ and $S_n$ of the 2nd shift register 23 during the sustain-discharge period.

1st and 2nd latches 22 and 24 are each provided with outputs $L_1, L_2, \ldots, L_{n-1}$ and $L_n$. The number of the outputs is equal to that of the scan electrode lines $Y_1, Y_2, \ldots, Y_n$ The 1st latch 22 temporarily stores the output signals of the 1st shift register 21 for scanning and enables the signals in response to a first strobe signal STB1 from the controller 5. Pairs of control logic parts 201 and 205, . . . connected to the outputs $L_1, L_2, \ldots, L_{n-1}$ and $L_n$ of the 1st latch 22 and level shifters 202, . . . control pairs of switches $S_{11}$ and $S_{12}$, . . . . The 2nd latch 24 temporarily stores the output signals of the 2nd shift register 24 for sustaining discharge and enables the signals in response to a second strobe signal STB2 from the controller 5. Pairs of control logic parts 203 and 204, . . . connected to the outputs $L_1, L_2, \ldots, L_{n-1}$ and $L_n$ of the 2nd latch 24 control pairs of switches $S_{13}$ and $S_{14}$ . . . .

The following description concerns switching for addressing a first scan electrode line $Y_1$ during a unit address period. When only the switch $S_{11}$ is closed in a state in which all the switches $S_{11}$, $S_{12}$, $S_{13}$, $S_{14}$, . . . open, the bias voltage-Vybias for scanning of the power source terminal Vpp is applied to the first scan electrode line $Y_1$. Next, when only the switch $S_{12}$ is closed in a state in which all the switches $S_{11}$, $S_{12}$, $S_{13}$, $S_{14}$, . . . open, the scanning voltage-Vy of the power source terminal Vss is applied to the first scan electrode line $Y_1$. After the first scan electrode line $Y_1$ is completely addressed, subsequently, a second scan electrode line $Y_2$ is addressed in the same way.

The following description concerns switching for generating and applying a discharge sustaining signal to the first scan electrode line $Y_1$ during the sustain-discharge period. When only the switch $S_{13}$ is closed in a state in which all the switches $S_{11}, S_{12}, S_{13}, S_{14}, \ldots$ open, a condenser C performs discharge, and thus current flows in the first scan electrode line $Y_1$ via a diode D11, so that electrical charge in the condenser C can be reused. Next, when only the switch $S_{11}$ is closed in a state in which all the switches $S_{11}$, $S_{12}$, $S_{13}$, $S_{14}$, . . . open, the discharge sustaining voltage Vs of the power source terminal Vpp is applied to the first scan electrode line $Y_1$. Next, when only the switch $S_{14}$ is closed in a state in which all the switches $S_{11, S12}, S_{13}, S_{14}, \ldots$ open, the capacitive power consumption between the first common electrode line $X_1$ and the first scan electrode line $Y_1$ is recovered to the condenser C via the diode D12. Next, when only the switch $S_{12}$ is closed in a state in which all the switches $S_{11}$, $S_{12}$, $S_{13}$, $S_{14}$, . . . open, the ground voltage GND of the power source terminal Vss is applied to the first scan electrode line $Y_1$.

The above switching during the sustain-discharge period is simultaneously performed for the other scan electrode lines $Y_2, \ldots, Y_{n-1}, Y_n$ by the switches not shown.

Figure 1:
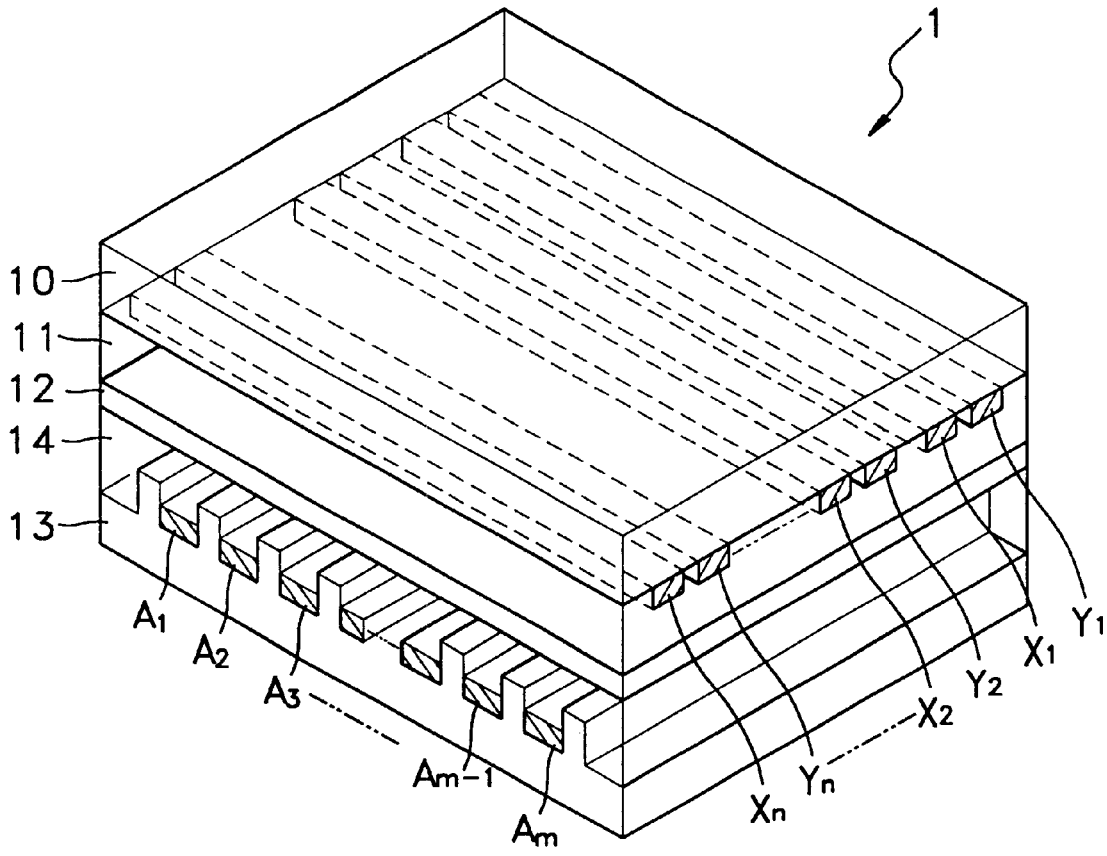
FIG. 1 shows a general three-electrode alternating current (AC) surface-discharge type plasma display panel (PDP)
Figure 2:
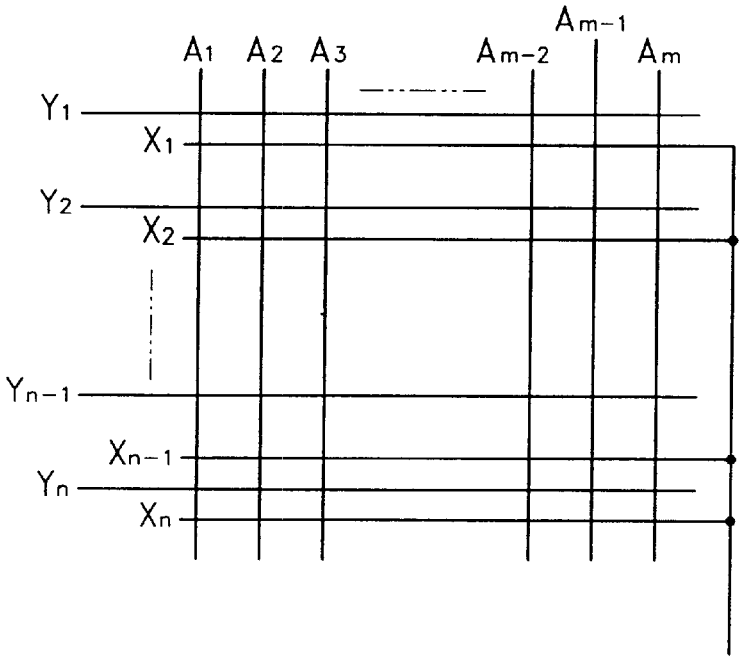
FIG. 2 shows an electrode line pattern of the PDP shown in FIG. 1.
Figure 3:
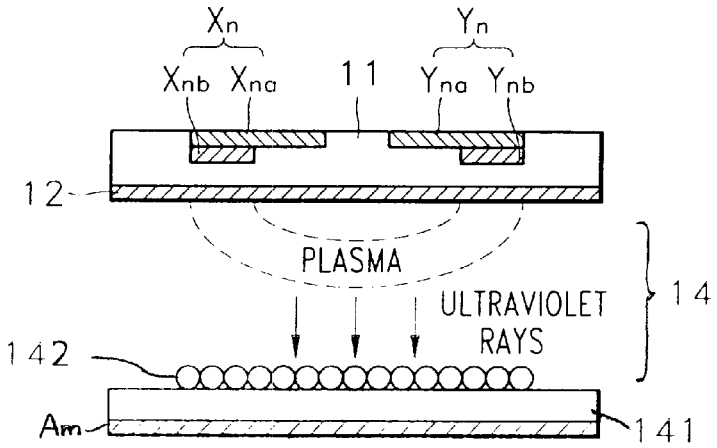
FIG. 3 shows another view of one pixel in the PDP of FIG. 1.

As described above, in the apparatus of FIG. 4 for driving the PDP 1 of FIG. 1 according to the present invention, the scanning driver 2 applies the scanning signals to the scan electrode lines $Y_1, Y_2, \ldots, Y_{n-1}$ and $Y_n$ in response to the scan data during the address period and also applies the discharge sustaining signals to the scan electrode lines $Y_1, Y_2, \ldots, Y_{n-1}$ and $Y_n$ in response to the discharge sustain data during the sustain-discharge period. Accordingly, the present invention does not require an additional discharge sustaining driver for the scan electrode lines $Y_1, Y_2, \ldots, Y_{n-1}$ and $Y_n$, thereby simplifying a driving circuit and a control algorithm and decreasing manufacturing costs.

Although the invention has been described with reference to a particular embodiment, it will be apparent to one of ordinary skill in the art that modifications of the described embodiment may be made without departing from the spirit and scope of the invention.

What is claimed is:

1. An apparatus for driving a plasma display panel (PDP) having front and rear substrates to be separated and opposed to each other and having common, scan and address electrode lines between the front and rear substrates, the common electrode lines and the scan electrode lines being arranged in parallel, the address electrode lines being arranged to be orthogonal to the scan electrode lines, thereby defining pixels corresponding to the respective intersections, the apparatus comprising:

a scanning driver in which a scanning circuit is combined with a discharge sustaining circuit with respect to each of the scan electrode lines, the scanning driver applying scanning signals to the scan electrode lines in response to scan data in a predetermined scanning order during an address period for forming wall charges at pixels to be selected and applying discharge sustaining signals to the scan electrode lines in response to discharge sustain data during a sustain-discharge period for generating light at the selected pixels;

an address driver for applying address signals to the address electrode lines in response to an input display data signal;

a common driver for applying common signals to the common electrode lines in response to an input common data signal; and a controller for processing externally input image data and generating the scanning data, the discharge sustain data, the display data signal and the common data signal;

wherein the scanning circuit of the scanning driver comprises:

a scanning shift register with outputs, the number of outputs being equal to that of the scan electrode lines, the scanning shift register sequentially outputting the scan data from the controller through the outputs of the scanning shift register during the address period; and a switching circuit for scanning which selectively applies a scanning voltage to the scan electrode lines in response to the scan data from the outputs of the scanning shift register during the address period;

and wherein the discharge sustaining circuit of the scanning driver comprises:

a discharge sustaining shift register with outputs, the number of outputs being equal to that of the scan electrode lines, the discharge sustaining shift register sequentially outputting the discharge sustain data from the controller through the outputs of the discharge sustaining shift register during the sustain-discharge period; and a switching circuit for sustaining discharge with charge/discharge means for recovering and using capacitive power consumption between the common electrode lines and the scan electrode lines, the switching circuit for sustaining discharge applying a discharge sustaining voltage to the scan electrode lines in response to the discharge sustain data output from the outputs of the discharge sustaining shift register during the sustain-discharge period.

2. An apparatus for driving a plasma display panel (PDP) having common, scan and address electrode lines, the common electrode lines and the scan electrode lines being arranged in parallel, the address electrode lines being arranged to be orthogonal to the scan electrode lines, thereby defining pixels corresponding to the respective intersections, the apparatus comprising:

a scanning driver comprising a scanning circuit combined with a discharge sustaining circuit with respect to each of the scan electrode lines, the scanning driver forming wall charges at pixels to be selected and generating light at the selected pixels;

an address driver to apply address signals to the address electrode lines in response to an input display data signal;

a common driver to apply common signals to the common electrode lines in response to an input common data signal; and a controller to process externally input image data and to generate scan data, discharge sustain data, the display data signal and the common data signal;

wherein the scanning circuit of the scanning driver comprises:

a scanning shift register to output the scan data during the address period; and a switching circuit to selectively apply a scanning voltage to the scan electrode lines in response to the scan data from the scanning shift register during the address period;

and wherein the discharge sustaining circuit of the scanning driver comprises:

a discharge sustaining shift register to output the discharge sustain data during the sustain-discharge period; and a switching circuit for sustaining discharge to apply a discharge sustaining voltage to the scan electrode lines in response to the discharge sustain data output from the discharge sustaining shift register during the sustain-discharge period.

3. The apparatus of claim 2, wherein the switching circuit for sustaining discharge includes means for recovering and using capacitive power consumption between the common electrode lines and the scan electrode lines.

4. An apparatus for driving a plasma display panel (PDP) having common, scan and address electrode lines, the common electrode lines and the scan electrode lines being arranged in parallel, the address electrode lines being arranged to be orthogonal to the scan electrode lines, thereby defining pixels corresponding to the respective intersections, the apparatus comprising:

a scanning driver comprising a scanning circuit combined with a discharge sustaining circuit with respect to each of the scan electrode lines, the scanning driver forming wall charges at pixels to be selected and generating light at the selected pixels;

an address driver to apply address signals to the address electrode lines in response to an input display data signal;

a common driver to apply common signals to the common electrode lines in response to an input common data signal; and a controller to process externally input image data and to generate scan data, discharge sustain data, the display data signal and the common data signal;

wherein the scanning circuit of the scanning driver comprises:

a scanning memory to output the scan data during the address period; and a switching circuit to selectively apply a scanning voltage to the scan electrode lines in response to the scan data from the scanning memory during the address period;

and wherein the discharge sustaining circuit of the scanning driver comprises:

a discharge sustaining memory to output the discharge sustain data during the sustain-discharge period; and a switching circuit for sustaining discharge to apply a discharge sustaining voltage to the scan electrode lines in response to the discharge sustain data output from the discharge sustaining memory during the sustain-discharge period.

5. The apparatus of claim 4, wherein the switching circuit for sustaining discharge includes means for recovering and using capacitive power consumption between the common electrode lines and the scan electrode lines.

6. The apparatus of claim 4, wherein the scanning memory comprises a shift register to sequentially output the scan data.

7. The apparatus of claim 6, wherein the switching circuit for sustaining discharge includes means for recovering and using capacitive power consumption between the common electrode lines and the scan electrode lines.

8. The apparatus of claim 4, wherein the discharge sustaining memory comprises a shift register to sequentially output the discharge sustain data.

9. The apparatus of claim 8, wherein the switching circuit for sustaining discharge includes means for recovering and using capacitive power consumption between the common electrode lines and the scan electrode lines.

* * * * *